US008109339B2

(12) United States Patent
Xu

(10) Patent No.: US 8,109,339 B2
(45) Date of Patent: Feb. 7, 2012

(54) ZERO BACKLASH DOWNHOLE SETTING TOOL AND METHOD

(75) Inventor: Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 355 days.

(21) Appl. No.: 12/545,424

(22) Filed: Aug. 21, 2009

(65) Prior Publication Data

US 2011/0042105 A1 Feb. 24, 2011

(51) Int. Cl.
*E21B 23/00* (2006.01)

(52) U.S. Cl. ..... 166/382; 166/237

(58) Field of Classification Search ..... 166/382, 166/217, 237, 206

See application file for complete search history.

(56) References Cited

U.S. PATENT DOCUMENTS

| | | | | |
|---|---|---|---|---|
| 5,348,090 | A * | 9/1994 | Leismer | 166/211 |
| 6,241,032 | B1 * | 6/2001 | Falgout, Sr. | 175/318 |
| 7,503,390 | B2 * | 3/2009 | Gomez | 166/323 |
| 7,896,111 | B2 * | 3/2011 | Slack | 175/423 |
| 7,909,120 | B2 * | 3/2011 | Slack | 175/423 |
| 2009/0065217 | A1 * | 3/2009 | Ross | 166/373 |
| 2009/0229832 | A1 * | 9/2009 | King | 166/373 |
| 2011/0042103 | A1 * | 2/2011 | Xu | 166/382 |
| 2011/0042104 | A1 * | 2/2011 | Xu | 166/382 |

OTHER PUBLICATIONS

Zbitowsky, R., et al. Pressure Transient Analysis Data Collected by the Use of a Retrievable Gauge Hanger in Saudi Arabian Gas Wells, SPE 113589, Society of Petroleum Engineers, Presentation at the 2008/ICoTA Coiled Tubing and Well Intervention Conference and Exhibition, The Woodlands, TX, Apr. 1-2, 2008, pp. 1-8.

* cited by examiner

*Primary Examiner* — Daniel P Stephenson
(74) *Attorney, Agent, or Firm* — Cantor Colburn LLP

(57) ABSTRACT

A zero backlash downhole setting tool including a mandrel; a body lock ring at the mandrel; a setting sleeve in operable communication with a device to be set; a rotary take-up in tensile force transmissive contact with the device to be set; and a follower housing configured to follow the rotary take-up in a first mode of operation and extend away therefrom in another mode of operation, the follower being engaged with the body lock ring and method.

16 Claims, 2 Drawing Sheets

ZERO BACKLASH DOWNHOLE SETTING TOOL AND METHOD

BACKGROUND

Common in the downhole drilling and completion arts is the traditional body lock ring. The ring is well known and includes a finely threaded section commonly referred to as "wicker threads" or "wickers" on an inside dimension of the body lock ring that are configured to be engageable with a set of wickers on an outside dimension surface of another component. The body lock ring may be urged along the other component under an applied force to ratchet into a final set position. Because there is a finite distance between adjacent peaks of wicker threads, there is necessarily a potential backlash. In the event that the applied force brings the wickers to very close but not quite the next wicker trough, the device being actuated will relax in backlash by the distance between the wickers. It is possible to reduce backlash by reducing the peak-to-peak distance between adjacent wickers. A reduction in this dimension, however, is often accompanied by a reduction in every tooth dimension including height and flank surface area as well. A reduction in tooth flank surface area tends to proportionally reduce the "holding ability" of such flanks. While the backlash is necessarily reduced in this type of construction, the potential for slippage of the body lock so constructed is increased. Since slippage is unquestionably undesirable, wickers with reduced peak-to-peak dimensions are not often the selected solution to the backlash problem.

In some situations the backlash is inconsequential while in others it can be catastrophic to the function of the particular tool or device. For example, if the device is a sealing tool, the backlash may allow sufficient energy in the seal to relax that the seal function is substantially lost. In other devices, while the entire or any substantial part of the functionality may not be lost, it clearly would be better for the ring to retain the input energy than to lose energy. Hence, it is axiomatic that the art would well receive improved apparatus where backlash is reduced or eliminated.

SUMMARY

A zero backlash downhole setting tool including a mandrel; a body lock ring at the mandrel; a setting sleeve in operable communication with a device to be set; a rotary take-up in tensile force transmissive contact with the device to be set; and a follower housing configured to follow the rotary take-up in a first mode of operation and extend away therefrom in another mode of operation, the follower being engaged with the body lock ring.

A zero backlash downhole setting tool including a setting sleeve; a linear to rotary motion converter depending from the setting sleeve; a rotary take-up; a follower housing forming an interface with the rotary take-up; and a body lock ring in operable communication with the follower housing, a backlash of the body lock ring being counteractable by a change in combined length of the rotary take-up and the follower housing.

A method for setting a downhole tool with zero backlash including urging a setting sleeve against one or more resilient elements; transmitting a setting force to a device to be set through the one or more resilient elements; pulling a rotary take-up and a follower housing thereby causing a ratcheting of a body lock ring with the follower housing; axially translating a pin connected to the setting sleeve to impart a rotation to the rotary take-up; and extending the combined length of the rotary take-up and the follower housing to counteract backlash in the body lock ring.

BRIEF DESCRIPTION OF THE DRAWINGS

Referring now to the drawings wherein like elements are numbered alike in the several figures.

DETAILED DESCRIPTION

Figure 1:
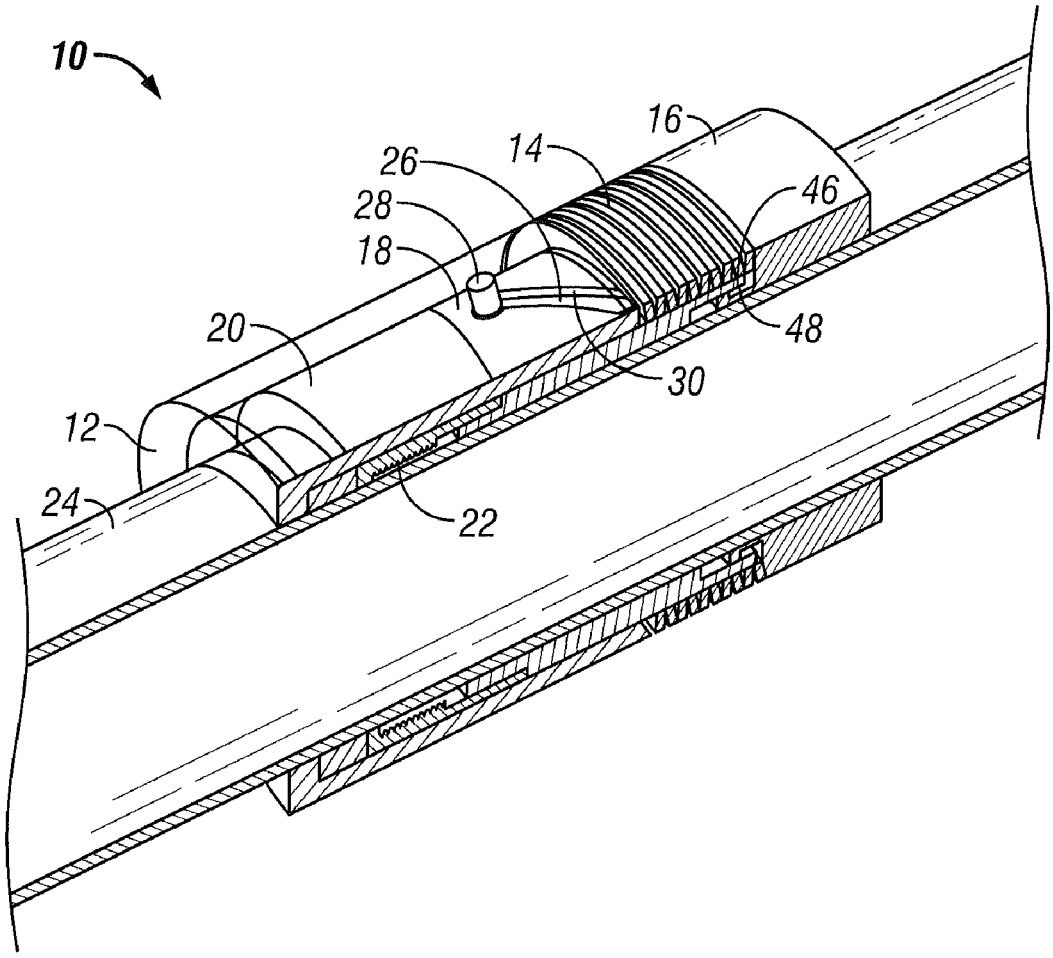
FIG. 1 is a schematic perspective cross sectional view of a zero backlash downhole setting tool as described herein with a setting sleeve shown in phantom to illustrate underlying structure.

Referring to FIG. 1, a perspective cross-section view of a zero backlash downhole setting tool 10 is illustrated. The tool comprises a setting sleeve 12 (shown in phantom to allow visibility of the underlying components) in force transferable communication with one or more resilient elements 14. The one or more elements may comprise a coil spring, a series of spring washers, which may be of the frustoconical type, or any other resilient configuration that allows for force transmission sufficient to set a settable device 16 and yet allow for sufficient further compression to allow the setting sleeve to actuate other components as disclosed hereunder. The one or more elements 14 are in force transferable communication with the device 16 to be set in the downhole environment. The device 16 may be a seal or may be any other type of device that can be set downhole upon axial actuation. Further included in the tool 10 are a rotary take-up 18 and follower housing 20, the follower housing 20 being in operable communication with a body lock ring 22, which itself is in operable communication with a mandrel 24.

Figure 2:
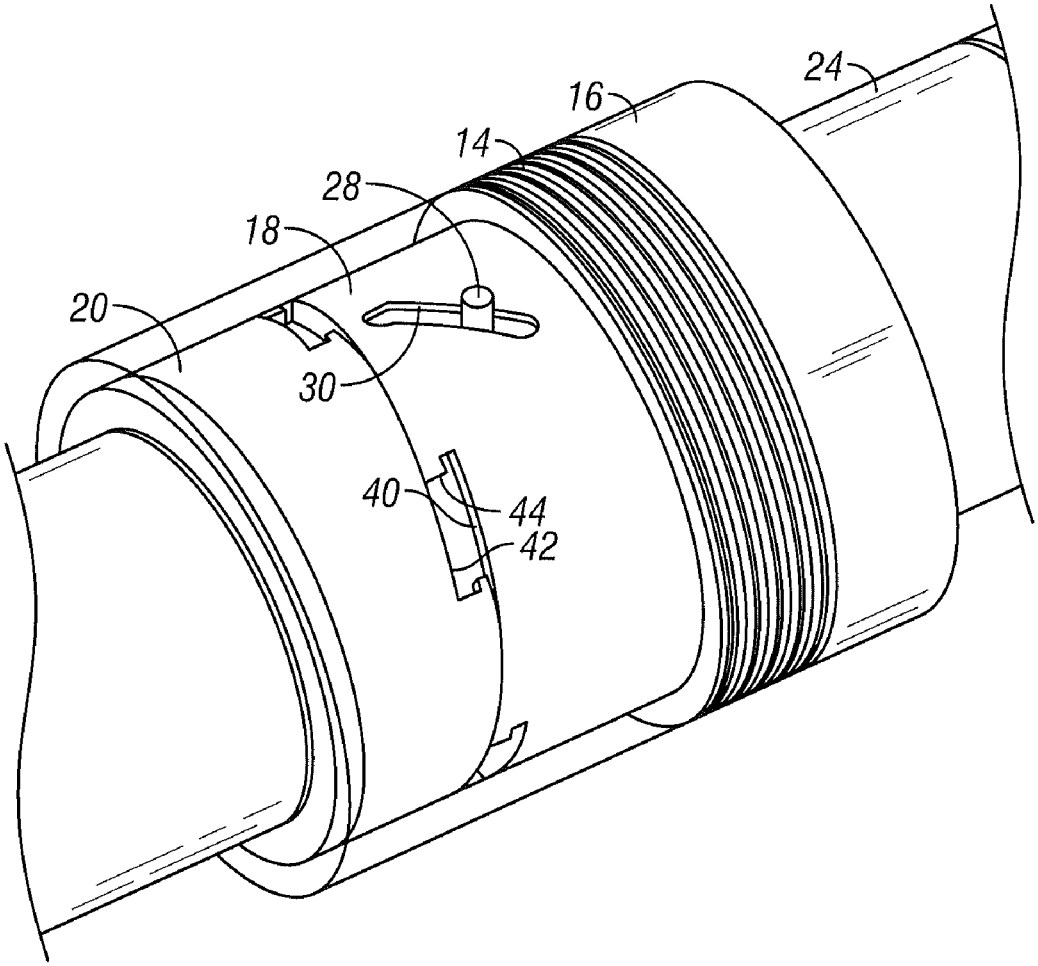
FIG. 2 is a perspective view of the tool illustrated in FIG. 1 without a setting sleeve shown and in the actuated position.

Referring to FIGS. 1 and 2, the rotary take-up 18 includes one or more slots 26 that are receptive to a pin 28 that is mounted to the setting sleeve 12. Movement of the pin 28 in an axial direction of the tool 10 will cause the rotary take-up 18 to rotate. This is due to angled surface 30, upon which the pin 28 will bear when urged toward the device 16 during setting of the device 16. Loaded contact between the pin 28 and the surface 30 occurs in use only after the device 16 to be set has been set and stopped moving downhole. Thereafter, the one or more resilient elements 14 are further compressed by the setting sleeve 12, which translates the pin 28 toward the device 16 and into contact with the surface 30 thereby rotating the rotary take-up 18.

Referring to FIG. 2, it is to be noted that the interface between rotary take-up 18 and follower housing 20 is helical. The interface may comprise a single helix or may comprise a number of shorter part helical ramps 40 and 42 as illustrated in FIG. 2. It will also be noted that one or more hooks 44 prevent the rotary take-up 18 from being longitudinally separated from the follower housing 20 at least until relative rotation occurs therebetween. The need for this feature will become clearer during discussion of the operation of the tool 10 hereunder.

Referring back to FIG. 1, there is shown a configuration (here shown as groove 46) that is intended to function to cause the rotary take-up 18 to be drawn along with the device 16 when that device is moved downhole pursuant to setting of the device 16. This puts the rotary take-up and follower housing in tension, relying upon the hooks 44 to maintain the two components connected to one another. The configuration is illustrated as a hook that is integral with the device 16 but it is to be understood that any arrangement that allows affixation of the rotary take-up to the device 16 while permitting relative rotation between the two will be equally effective. This includes but is not limited to set screws extending through one of the rotary take-up 18 and the device 16 into a groove of the other of the same two components. As illustrated, screws 48 extend from the rotary take-up into a groove 46 in the device 16. As noted above these could easily be configured oppositely.

In operation, the tool 10 is run into a borehole (not shown) and a setting load is placed upon the setting sleeve 12 from some remote location such as a surface location. The setting sleeve compresses the one or more resilient elements 14 to a partial degree that is sufficient for the setting force to be transmitted to the device 16 to be set. The device is hence set using that force. During the movement that is a part of the setting action of the device 16, for example the movement of an uphole end of a seal relative to a downhole end of a seal, the rotary take-up and the follower housing are drawn downhole. The impetus for this first mode of operation is the groove in the device 16 as shown and through the set screws 46 into the rotary take-up 18, through the hooks 44 and into the follower housing 20. As the follower housing 20 moves in the downhole direction, it ratchets along the body lock ring 22 which itself ratchets along mandrel 24. The follower housing 20 is not loaded in compression by anything but rather simply drawn along by tensile load. The ratcheting along the body lock ring provides an anchoring function for the set force and is similar to any common body lock ring operation. It does suffer the drawback of backlash just as do similar devices of the prior art. In accordance with the invention described herein however, the backlash is counteracted with other components of the tool 10 as further described hereunder.

Once the device 16 is fully set, it stops moving downhole and the setting force of the setting sleeve mounts on the one or more resilient elements 14. The elements 14 continue to deform under this load and accordingly occupy less axial space. This allows the setting sleeve 12 to continue to move toward the device 16 without the device 16 moving. Because the pin 28 is connected to the sleeve 12, it too will translate toward the device 16. Further, because the rotary take-up 18 and follower housing 20 are only moved axially by tensile load from the device 16, they do not move directly axially at this stage. Rather, as the pin 28 comes into loaded contact with the surface 30, a rotary input is caused for the rotary take-up 18, which responsively rotates. The rotation, a second mode of operation, causes the helical ramp or part helical ramps 40 and 42 as shown to climb each other, effectively lengthening the combined length of rotary take-up 18 and follower housing 20. The increase in length will cause the follower housing to move away from the device 16 thereby taking up the backlash in the body lock ring 22. It is noted that because the follower housing 20 nor the rotary take-up 18 are compressively loaded during the process thus far described, the rotary input of the pin 28 will easily rotate the rotary take-up 18 and the ramps 40 and 42 will easily slide past one another. Once the rotation of the rotary take-up is complete however, meaning that all of the backlash in the system has been counteracted by the lengthening of the combined length of the rotary take-up 18 and the follower housing 20, the rotary take-up and follower housing 20 will be subjected to compressive load upon release of the setting force from the setting sleeve. Under this compressive load, rotation of the rotary take-up is inhibited by friction to the point that such rotation is prevented. The angles alpha of the ramps 40 and 42 are selected to disallow backdriving thereof. Angles providing this result range from greater than about 0 degrees to about 45 degrees, with one specific embodiment being at about 5 degrees. The angle alpha appropriately selected in accordance herewith can be determined using the formula:

$$\text{alpha} = \arctan(\text{coefficient of friction})$$

It should be appreciated that the greater the angle, the less the required stroke of the setting sleeve and the less rotation of the rotary take-up needed to counteract backlash however, the greater the angle, the easier for the system to be back driven. For higher angles the ramps 40 and 42 will require friction enhancing surface treatments such as roughness.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A zero backlash downhole setting tool comprising:
- a mandrel;
- a body lock ring at the mandrel;
- a setting sleeve in operable communication with a device to be set;
- a rotary take-up in tensile force transmissive contact with the device to be set; and
- a follower housing configured to follow the rotary take-up in a first mode of operation and extend away therefrom in another mode of operation, the follower being engaged with the body lock ring.

2. A zero backlash downhole setting tool as claimed in claim 1 wherein the setting sleeve includes one or more pins in operable communication with the rotary take-up.

3. A zero backlash downhole setting tool as claimed in claim 1 wherein the rotary take-up includes one or more slots therein receptive to one or more pins of the setting sleeve.

4. A zero backlash downhole setting tool as claimed in claim 3 wherein the one or more slots are angled relative to an axis of the tool.

5. A zero backlash downhole setting tool as claimed in claim 1 wherein the rotary take-up tensile force transmissive contact with the device to be set is one or more set screws.

6. A zero backlash downhole setting tool as claimed in claim 1 wherein the rotary take-up is engaged with the follower housing at an interface having one or more hooks to transfer tensile load.

7. A zero backlash downhole setting tool as claimed in claim 1 wherein the rotary take-up is engaged with the follower housing at an interface having one or more helical ramps.

8. A zero backlash downhole setting tool as claimed in claim 7 wherein the one or more helical ramps have a helix angle in the range of greater than about 0 degrees to about 45 degrees.

9. A zero backlash downhole setting tool as claimed in claim 7 wherein the one or more helical ramps have a helix angle in the range of about 5 degrees.

10. A zero backlash downhole setting tool as claimed in claim 1 wherein the rotary take-up is rotationally drivable by axial movement of the setting sleeve.

11. A zero backlash downhole setting tool as claimed in claim 1 wherein upon rotational movement of the rotary take-up, a combined length of the rotary take-up and the follower housing increases.

12. A zero backlash downhole setting tool as claimed in claim 1 wherein one or more resilient elements are force transmissively positioned between the setting sleeve and the device to be set.

13. A zero backlash downhole setting tool as claimed in claim 12 wherein the one or more resilient elements are one or more spring washers.

14. A zero backlash downhole setting tool as claimed in claim 12 wherein the one or more resilient elements transmit a sufficient force to the device to be set to effect setting while still maintaining further compressibility.

15. A zero backlash downhole setting tool comprising:

a setting sleeve;

a linear to rotary motion converter depending from the setting sleeve;

a rotary take-up;

a follower housing forming an interface with the rotary take-up; and a body lock ring in operable communication with the follower housing, a backlash of the body lock ring being counteractable by a change in combined length of the rotary take-up and the follower housing.

16. A method for setting a downhole tool with zero backlash comprising:

urging a setting sleeve against one or more resilient elements;

transmitting a setting force to a device to be set through the one or more resilient elements;

pulling a rotary take-up and a follower housing thereby causing a ratcheting of a body lock ring with the follower housing;

axially translating a pin connected to the setting sleeve to impart a rotation to the rotary take-up; and extending the combined length of the rotary take-up and the follower housing to counteract backlash in the body lock ring.

* * * * *